US007500885B2

(12) United States Patent
Asao et al.

(10) Patent No.: US 7,500,885 B2
(45) Date of Patent: Mar. 10, 2009

(54) BULB SOCKET AND AN ASSEMBLING METHOD THEREFOR

(75) Inventors: Kazuhiro Asao, Yokkaichi (JP); Yoshikazu Machida, Isehara (JP)

(73) Assignees: Sumitomo Wiring Systems, Ltd. (JP); Ichikoh Industries, Ltd. (JP)

( * ) Notice: Subject to any disclaimer, the term of this patent is extended or adjusted under 35 U.S.C. 154(b) by 0 days.

(21) Appl. No.: 12/041,802

(22) Filed: Mar. 4, 2008

(65) Prior Publication Data

US 2008/0220653 A1 Sep. 11, 2008

(30) Foreign Application Priority Data

Mar. 8, 2007 (JP) ..... 2007-058843

(51) Int. Cl.
*H01R 24/00* (2006.01)

(52) U.S. Cl. ..... 439/699.1

(58) Field of Classification Search ..... 439/699.1, 439/699.2, 356

See application file for complete search history.

(56) References Cited

U.S. PATENT DOCUMENTS 5,630,729 A * 5/1997 Francis ..... 439/548
5,709,571 A * 1/1998 Briski et al. ..... 439/699.2

FOREIGN PATENT DOCUMENTS

JP 10-284204 10/1998
JP 2003-31328 1/2003

* cited by examiner

*Primary Examiner*—Phuong K Dinh
(74) *Attorney, Agent, or Firm*—Gerald E. Hespos; Anthony J. Casella

(57) ABSTRACT

A frame-shaped cover (30) for covering resilient holding pieces (23) is mounted at an opening edge of a fitting (11), and clearances Cb for permitting displacements of the cover (30) in forward and backward directions intersecting a mounting direction of a base (51) with respect to the fitting (11) are defined between the outer surfaces of front and rear walls (13F, 13R)) of the fitting (11) and the cover (30). Even if the base (51) is displaced forward or backward with respect to the fitting (11), the cover (30) can be displaced in conformity with the position of the base (51), wherefore the base (51) can be mounted reliably into the fitting (11).

11 Claims, 10 Drawing Sheets

BULB SOCKET AND AN ASSEMBLING METHOD THEREFOR

BACKGROUND OF THE INVENTION

1. Field of the Invention

The invention relates to a bulb socket.

2. Description of the Related Art

Japanese Unexamined Patent Publication No. 2003-31328 discloses a bulb socket with a rectangular tubular fitting configured for receiving the base of a wedge-base bulb. Terminal fittings are provided in the tubular fitting and have resilient holding pieces that engage retaining projections of the base when the base is inserted in the fitting. Thus, the base is retained and held by this engaging action.

The resilient holding pieces are exposed at an opening of the fitting in the above-described bulb socket. Thus, the leading end of the base of the bulb might enter a clearance between a surrounding wall of the fitting and the resilient holding piece and could inadvertently deform the resilient holding piece inward away from the surrounding wall of the fitting.

Japanese Unexamined Patent Publication No. H10-284204 discloses a frame-shaped cover that can be mounted at the opening of the fitting of a bulb socket. The cover covers the resilient holding pieces, and hence the base of the bulb cannot contact and damage the resilient holding piece. Thus, the cover may be considered a way to avoid damaging the resilient holding piece. However, the cover does not avoid all problems. More particularly, the light emitter of the bulb is held by a chuck of an assembling apparatus for mounting the wedge base bulb into the fitting of the bulb socket. Wedge base bulbs generally are made of glass and have large dimensional tolerances. Accordingly, an amount of displacement between a base and a light emitter can be large. Thus, even if the chuck and the light emitter are moved to specified positions, the position of the base can be displaced with respect to the fitting. In such a case, the base might interfere with the cover to hinder insertion of the base of the bulb into the fitting.

The invention was developed in view of the above and an object thereof is to enable a base of a wedge base bulb to be mounted reliably in a bulb socket that has a cover for protecting a resilient holding piece in a fitting.

SUMMARY OF THE INVENTION

The invention relates to a bulb socket with a substantially tubular fitting for receiving a base of a wedge base bulb. At least one terminal fitting is accommodated in the fitting. The terminal fitting is formed with at least one resilient holding piece that is engageable with the base inserted into the fitting to prevent detachment of the base from the fitting. A cover is mounted to the fitting for at least partly covering the resilient holding piece and permitting insertion of the base. Clearances are formed between at least one outer surface of one or more walls of the fitting and substantially face at least one surface of the cover facing the respective wall for permitting displacements of the cover in at least one direction intersecting a mounting direction of the base with respect to the fitting.

The cover can be displaced in conformity with the position of the base even if the base portion is displaced with respect to the fitting. Thus, the base can be mounted reliably into the fitting.

The resilient holding piece preferably extends along an inner peripheral surface of the fitting.

The cover preferably is substantially frame-shaped and/or preferably is mounted to an opening edge of the fitting.

The fitting portion preferably is a substantially rectangular tube. The clearances preferably are formed between the outer surfaces of a pair of substantially parallel walls of the fitting and surfaces of the cover facing the pair of walls.

The cover can be displaced in conformity with the position of the base portion even if the base is displaced with respect to the fitting. Thus, the base can be mounted reliably into the fitting.

At least one projection preferably is formed on the outer surface of the one or more walls, preferably of each of the pair of walls.

The cover preferably is displaceable to be inclined with respect to the fitting by coming into line or point contact with the fitting, and preferably with the projection thereof.

At least one guiding slant preferably is formed at the opening edge of a through hole of the cover for permitting the insertion of the base. The guiding slant reliably guides the base into the through hole.

One or more resilient locking pieces preferably are provided for locking the cover to the fitting. The resilient locking pieces preferably extend substantially along an arrangement direction of the cover to the fitting and interact with locking protrusions of the fitting.

The resilient locking piece preferably has two lateral sections and a locking section connecting the lateral sections to define a U-shape. The resilient locking piece is resiliently deformable in a direction intersecting the arranging direction with parts connected with a main portion of the cover as supporting points.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

Figure 1:
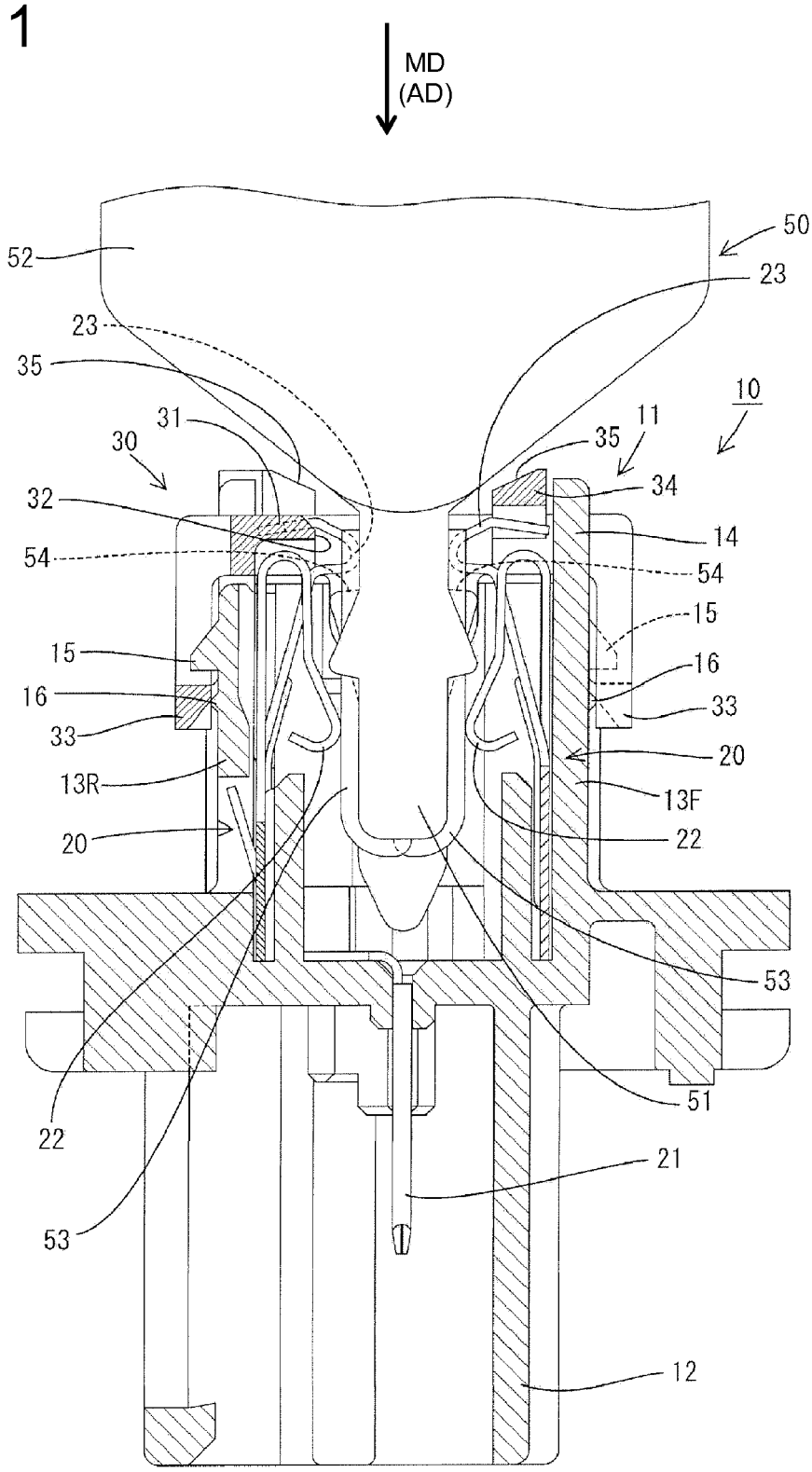
FIG. 1 is a section showing a state where a wedge base bulb is mounted in one embodiment.
Figure 2:
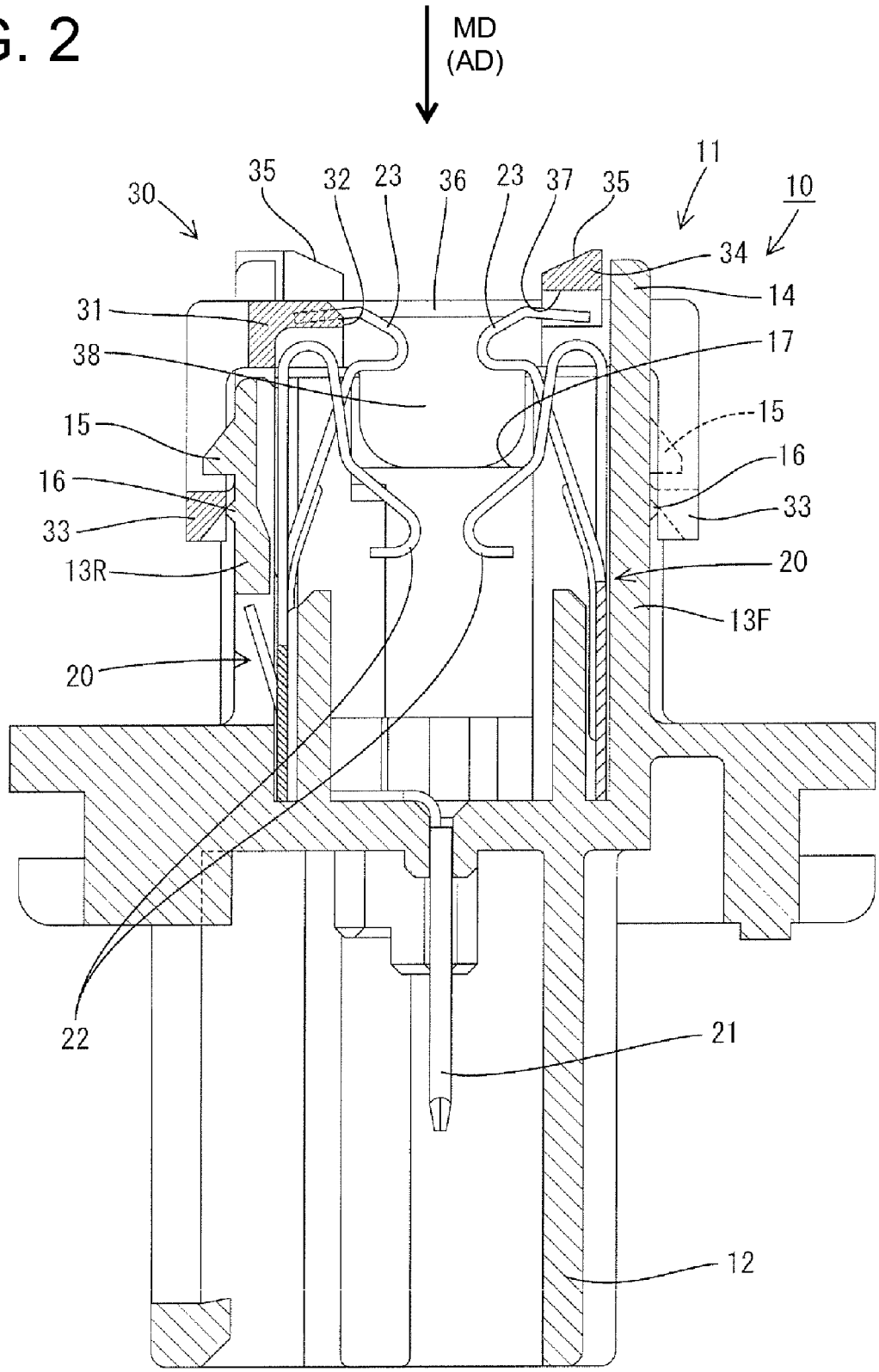
FIG. 2 is a section showing a state where the wedge base bulb is detached.

A bulb socket in accordance with the invention is made e.g. of a synthetic resin and is identified by the numeral 10 in FIGS. 1 to 10. A rectangular tubular fitting 11 is defined at an upper portion of the bulb socket 10 and has an open upper end. A receptacle 12 is defined at a lower portion of the bulb socket 10 and can receive an unillustrated connector. Left and right slits are formed in front and rear walls 13F and 13R of the fitting 11 and extend down from the upper end edge. Substantially rectangular plate-shaped restricting walls 14 are cantilevered at a central area in the transverse direction adjacent to and between the slits in each of the front and rear walls 13F, 13R. The restricting walls 14 are resiliently deformable substantially outward of the fitting 11.

Two locking protrusions 15 are formed on the outer surface of each of the front and rear walls 13F, 13R so that the restricting wall 14 is between the corresponding locking protrusions 15. All of the locking protrusions 15 are arranged at substantially the same height along the mounting direction MD. Projections 16 are formed below the respective locking protrusions 15 and define long narrow ribs extending substantially straight in the transverse direction. The cross section of the illustrated projections 16 is substantially trapezoidal, but may be substantially triangular, substantially semicircular or substantially fan-shaped. Guiding recesses 17 are formed in the inner surfaces of opposite left and right walls of the fitting 11.

Three terminal fittings 20 are accommodated in the bulb socket 10. One of the terminal fittings 20 includes one tab 21 that projects down into the receptacle 12 and two resilient contact pieces 22 are accommodated in the fitting 11. Each of the other terminal fittings 20 has one tab 21 projecting down into the receptacle 12, a resilient contact piece 22 accommodated in the fitting 11 and a resilient holding piece 23 accommodated in the fitting 11. Each resilient holding piece 23 projects up in the fitting portion 11 and extends substantially along the inner surface of the front wall 13F or rear wall 13R of the fitting 11. The resilient holding pieces 23 engage retaining projections 54 of a base 51 of a wedge base bulb 50 inserted into the fitting 11 in a mounting direction MD. Thus, an upward detachment in a direction substantially opposite to the mounting direction MD of the base 51 from the fitting 11 is prevented and the resilient contact pieces 22 are held resiliently in contact with terminal portions 53 on the outer surface of the base 51 to be connected electrically.

The cover 30 is made e.g. of a synthetic resin and is mounted to the bulb socket 10. The cover 30 includes a main portion 31 in the form of a substantially rectangular frame and a wide rectangular through hole 32 vertically penetrates the main portion 31. Pairs of front and rear resilient locking pieces 33 extending down from the left and right ends of the front and rear edges of the main portion 31. Rib-shaped projections 34 extend transversely along transverse intermediate parts of the front and rear edges of the upper surface of the main portion 31. Guiding slants 35 are defined at the upper surfaces of the rib-shaped projections 34 and slope down and in along the mounting direction MD towards the through hole 32. Obliquely tapered surfaces 36 are defined at the left and right upper opening edges of the through hole 32. Escaping recesses 37 are formed on the lower surfaces of the front and rear edges for avoiding interference with the respective resilient holding pieces 23 when the cover 30 is assembled with the bulb socket 10. Further, guiding plates 38 extend down on the left and right edges of the main portion 31.

Each resilient locking piece 33 has left and right substantially vertical sections 39 and a locking section 40 connects bottom ends of the left and right vertical sections 39 to define a U-shape. An obliquely aligned guiding groove 41 extends from an inner surface to a lower surface of a transverse middle part of the locking section 40. Facing surfaces 42 are defined on the inner surfaces of the resilient locking pieces 33 and face the outer surfaces of the front and rear walls 13F, 13R when the cover 30 is mounted on the fitting 11. The resilient locking pieces 33 are resiliently deformable forward and backward with the upper ends connected with the main portion 41 as supports.

The cover 30 is so assembled with the bulb socket 10 to cover at least part of the fitting 11 from above and in the mounting direction MD. In the processing of assembling the cover 30, the guiding plates 38 of the cover 30 are fit into the guiding recesses 17 of the fitting 11 to position the cover 30 with respect to the fitting 11 forward, backward and transversely in directions substantially orthogonal to an assembling direction AD of the cover 30. Thereafter, as the cover 30 is assembled further, the locking sections 40 of the resilient locking pieces 33 contact the locking protrusions 15. Thus, the guiding grooves 41 engage with the locking protrusions 15 and cause the resilient locking pieces 33 to deform resiliently away from the front and/or rear walls 13F, 13R. The resilient locking pieces 33 are restored resiliently when the locking sections 40 pass the locking protrusions 15, and the locking sections 40 engage the locking protrusions 15 from below in a direction opposite to the assembling direction AD to complete the assembly of the cover 30.

The main portion 31 of the assembled cover 30 is placed on and engages the upper surface of the opening edge of the fitting 11. Thus, the front and rear sections of the main portion 31 are located along the inner periphery of the opening of the fitting 11 to cover at least parts of the resilient holding pieces 23 close to the front wall 13F and the rear wall 13R in the fitting 11 (see FIGS. 1 to 4). The intrusion of external matter into a clearance between the upper ends of the resilient holding pieces 23 and the inner peripheral surface of the fitting 11 is prevented by these front and rear sections. Upper ends of the resilient holding pieces 23 enter the escaping recesses 37, and accordingly the cover 30 will not interfere with the resilient holding pieces 23.

Figure 3:
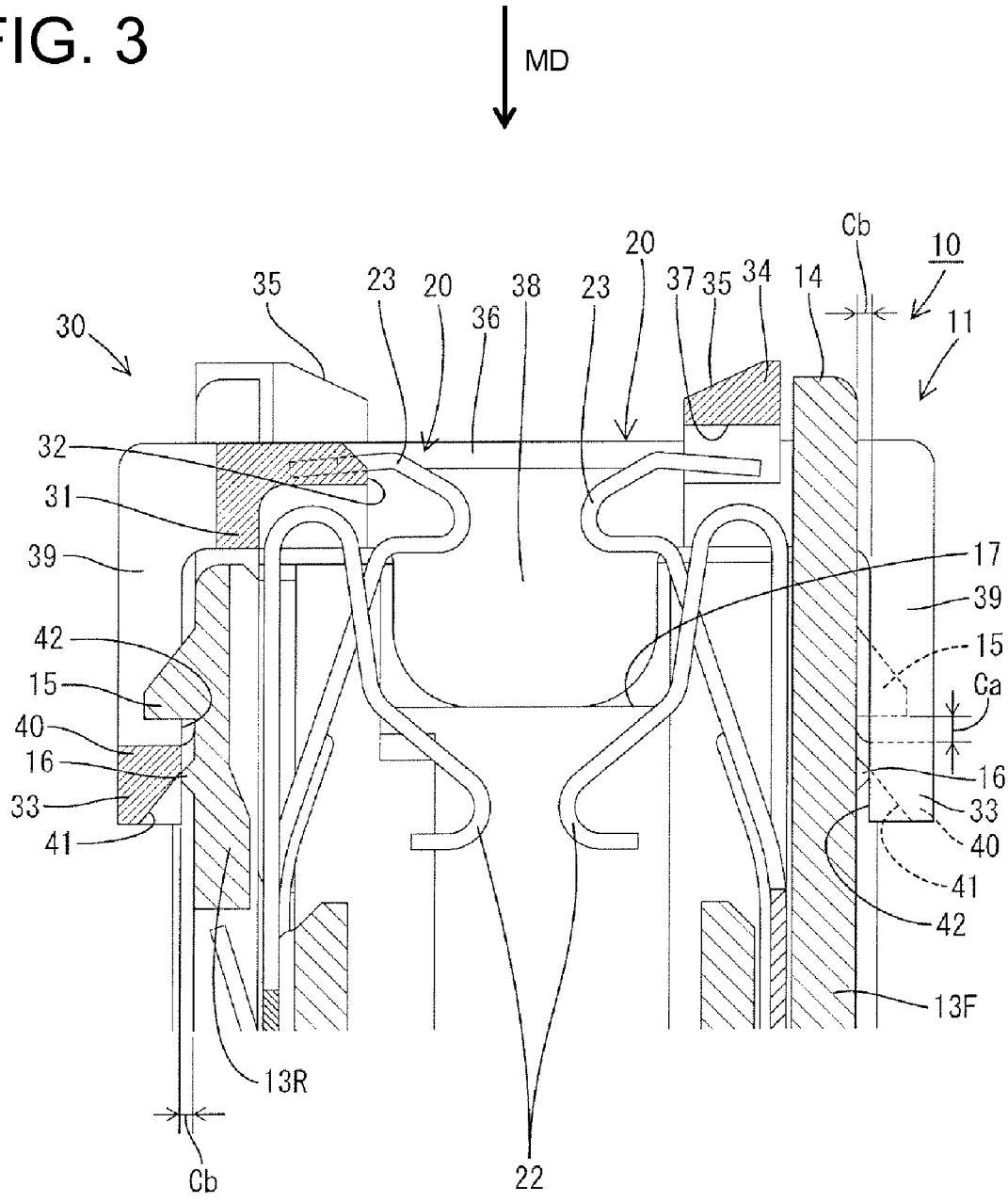
FIG. 3 is a partial enlarged view of FIG. 2.
Figure 4:
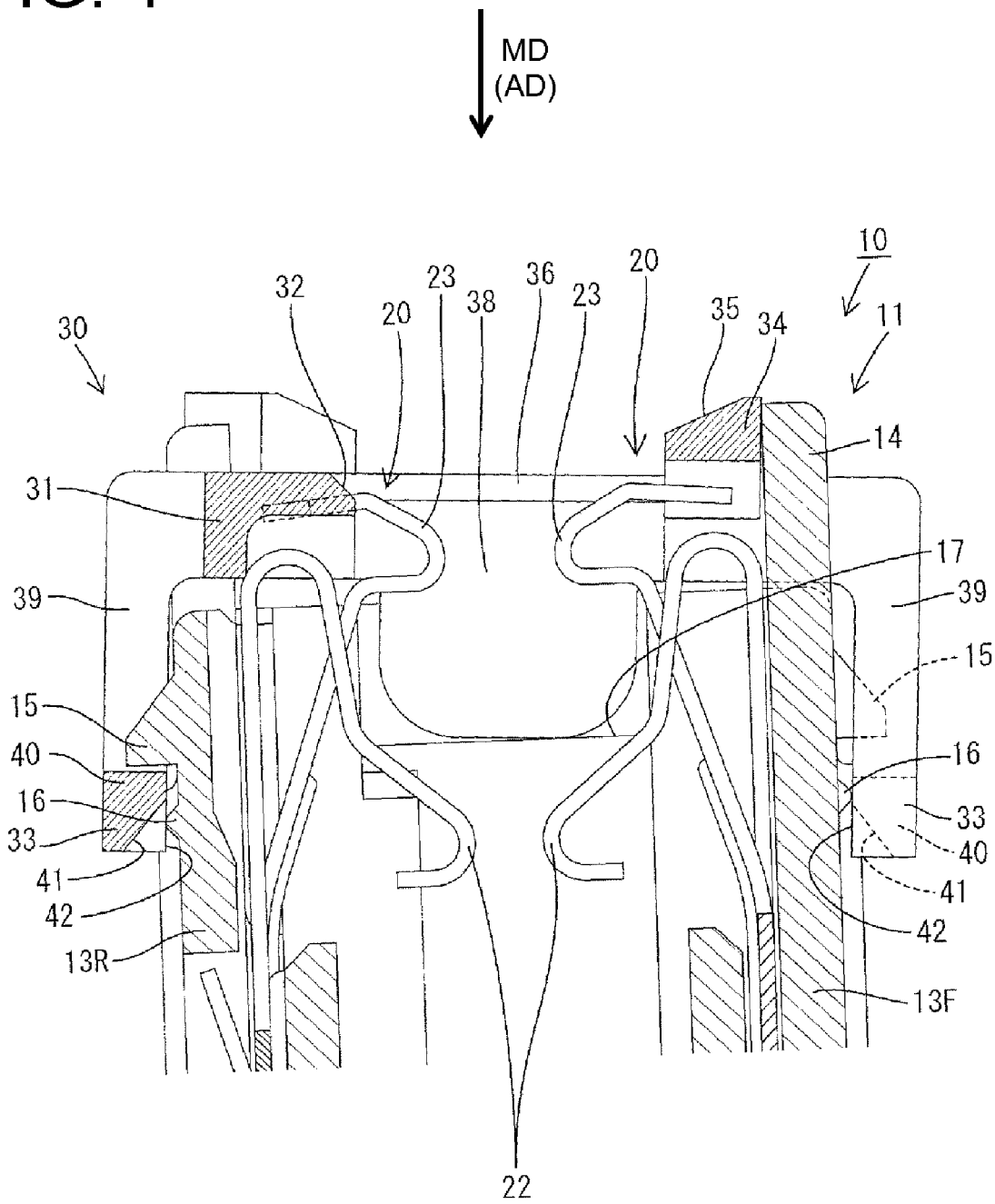
FIG. 4 is a section showing a state where a cover is inclined.
Figure 5:
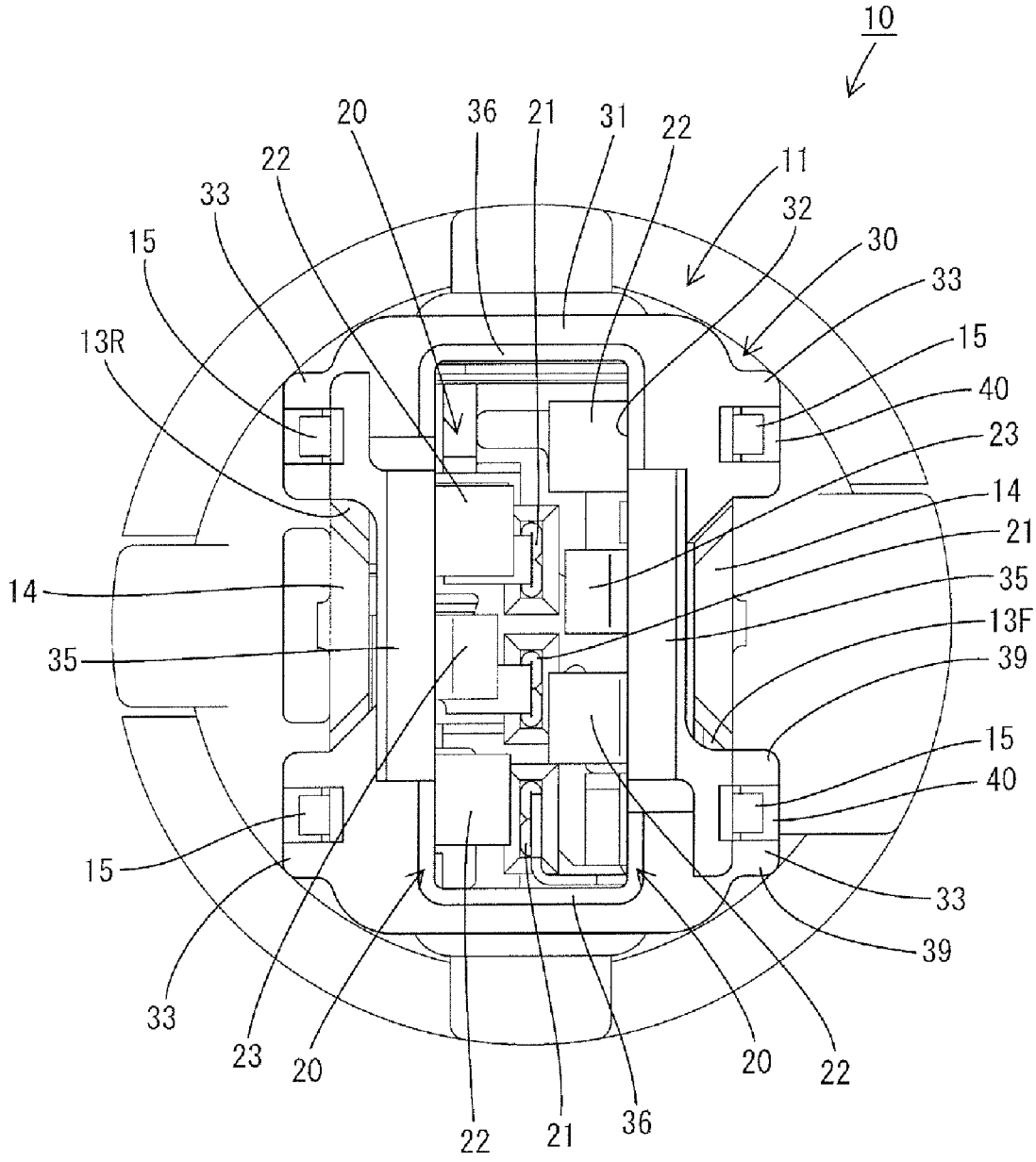
FIG. 5 is a plan view.
Figure 6:
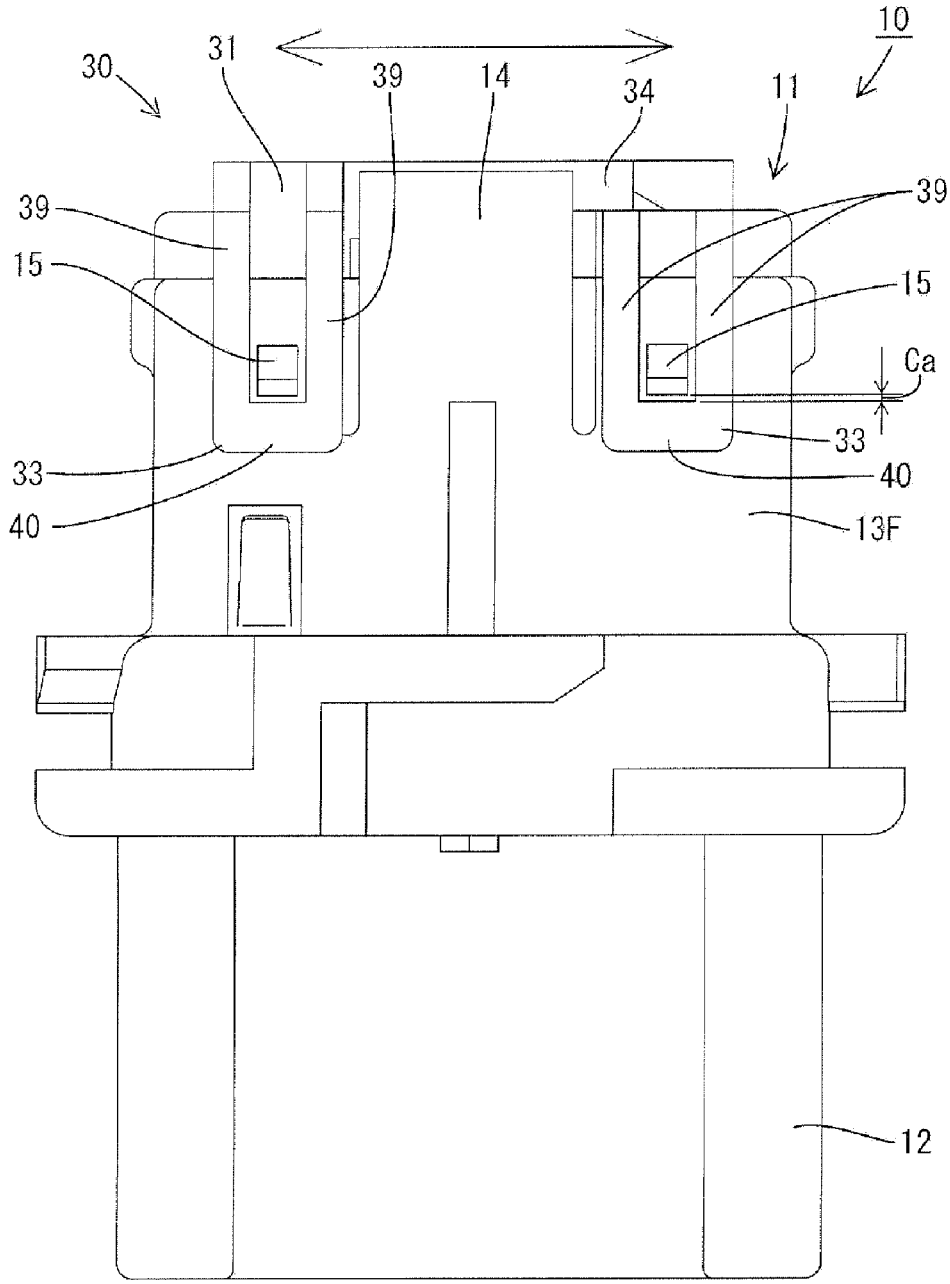
FIG. 6 is a front view.
Figure 7:
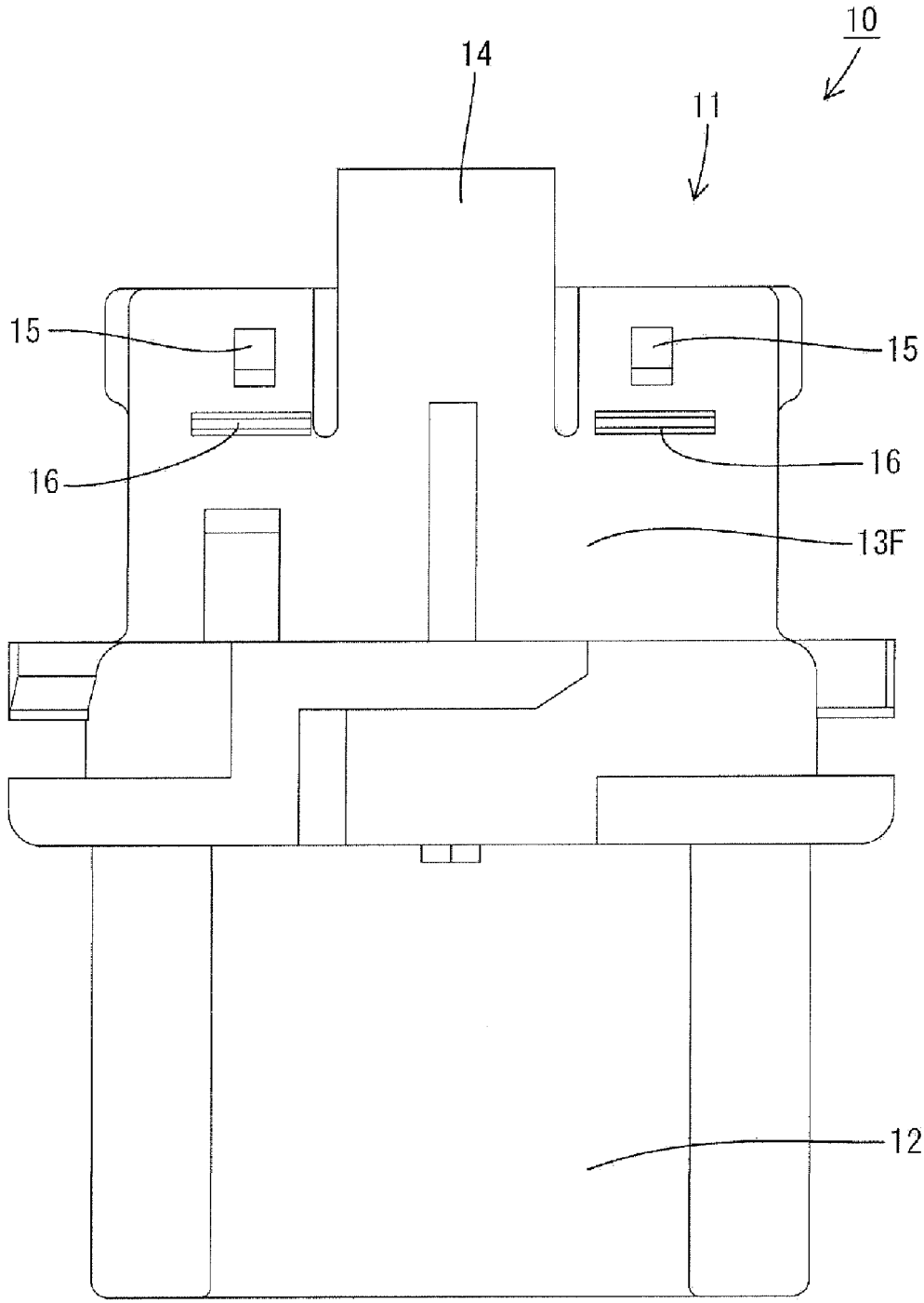
FIG. 7 is a front view showing a state where the cover is detached.
Figure 8:
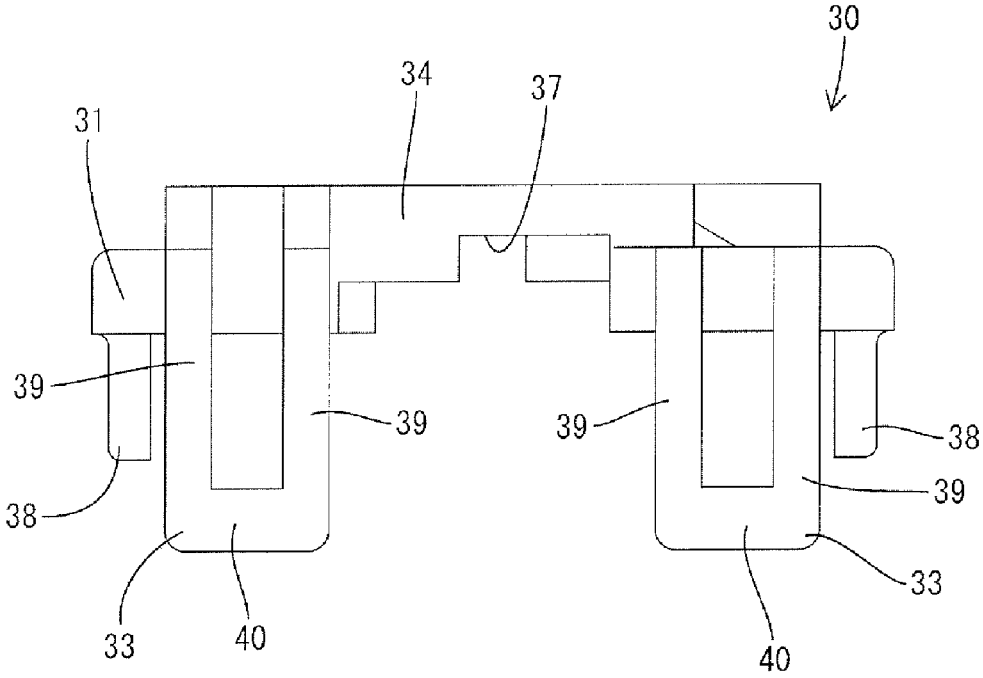
FIG. 8 is a front view of the cover.
Figure 9:
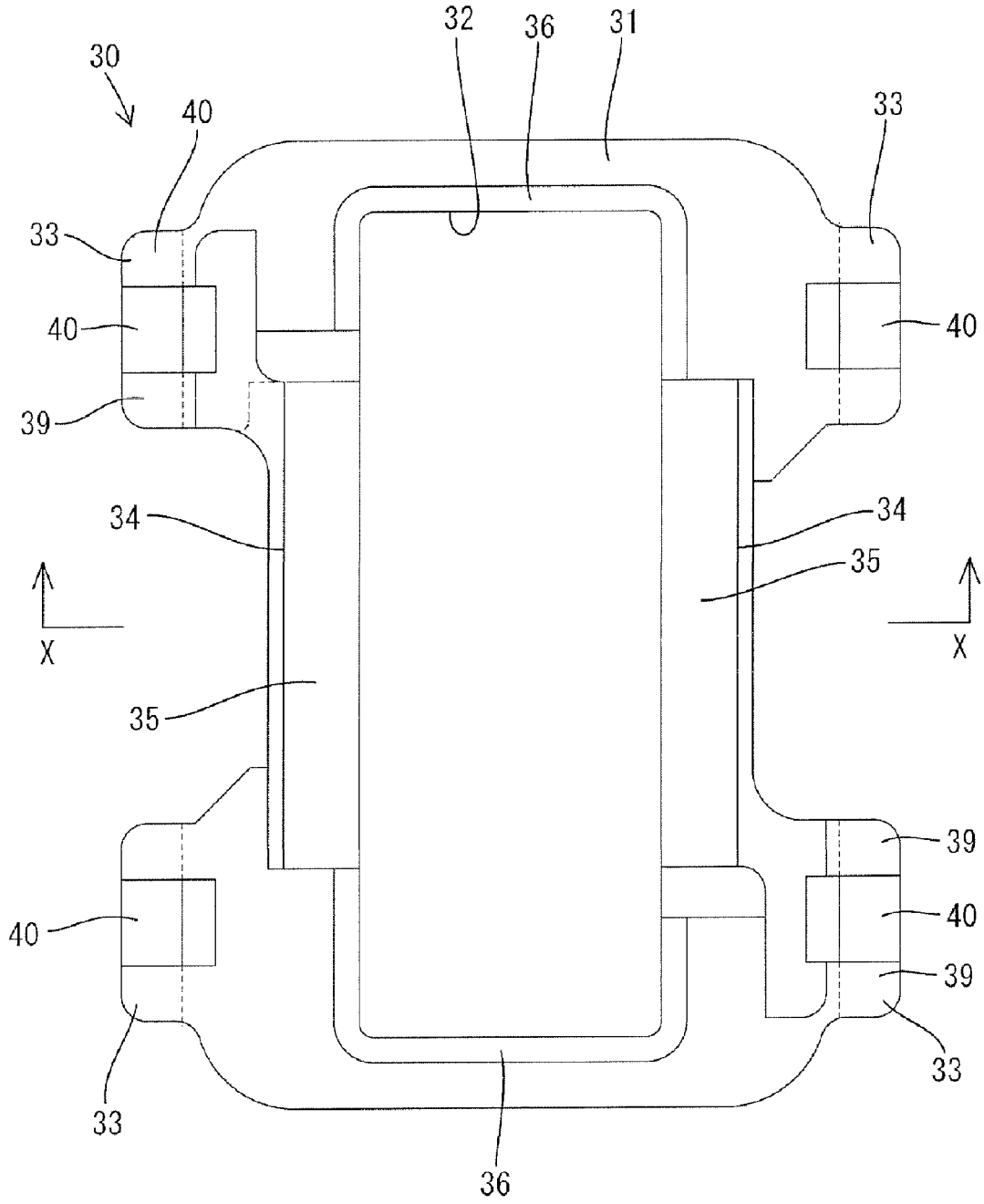
FIG. 9 is a plan view of the cover.
Figure 10:
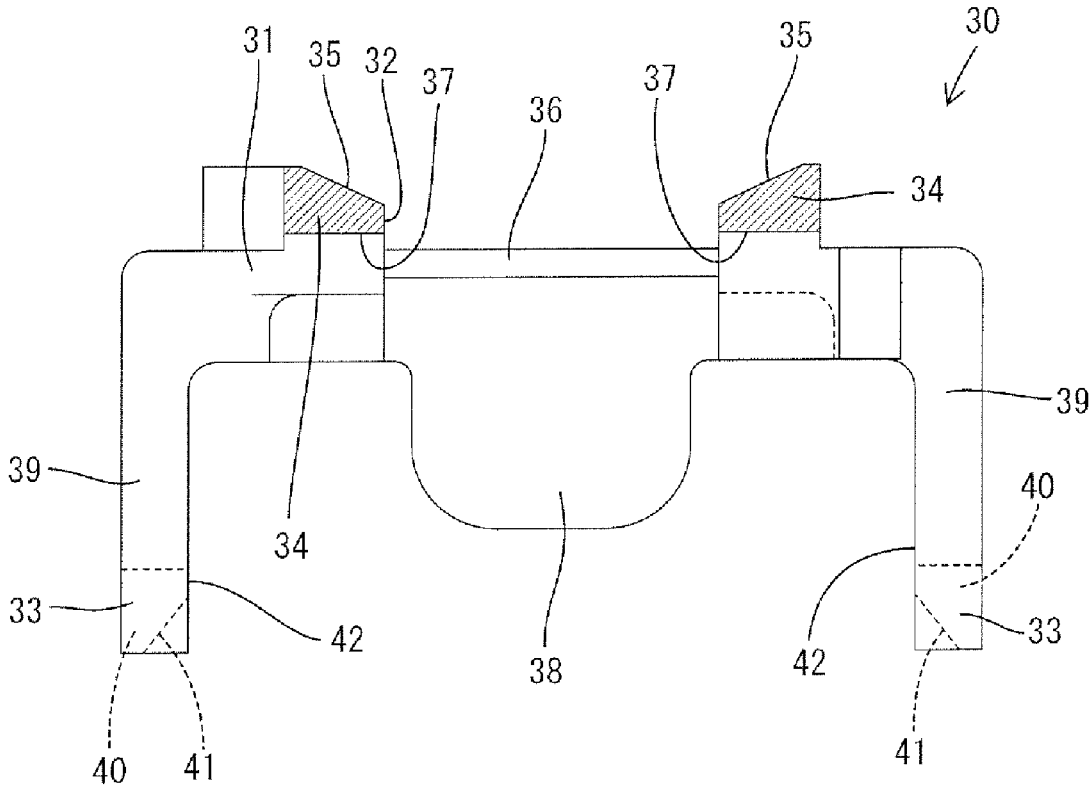
FIG. 10 is a section along X-X of FIG. 9.

The lower surfaces of the locking protrusions 15 and the upper surfaces of the locking sections 40 are vertically spaced apart along the assembling direction AD when the main portion 31 of the cover 30 is on the upper surface of the fitting 11 to form clearances Ca for permitting the cover 30 to incline forward and backward with respect to the bulb socket 10 (see FIGS. 3 and 6). Additionally, the outer surfaces of the front and rear walls 13F, 13R and the facing surfaces 42 of the resilient locking pieces 33 are spaced apart in forward and backward directions substantially normal to the assembling direction AD to form clearances Cb for permitting the cover 30 to incline forward and backward with respect to the bulb socket 10 (see FIG. 3). The projections 16 are arranged at substantially the same height as the locking sections 40, and the projections 16 and the inner facing surfaces 42 of the locking sections 40 are in a positional relationship to face each other in forward and backward directions substantially normal to the assembling direction AD while defining a tiny clearance therebetween. The clearances Ca and Cb enable the cover 30 to inclined forward and backward in directions substantially normal to a mounting direction MD of the wedge base bulb 50 into the fitting 11 with either the front or rear projections 16 as supports so as to displace the resilient locking piece 33 corresponding to the projections 16 at the opposite side upward (see FIGS. 3 and 4). A maximum upward displacement of the resilient locking pieces 33 at this time corresponds to the clearance Ca between the locking protrusions 15 and the locking sections 40.

A transverse distance between the outer surfaces of the guiding plates 38 is less than a distance between the inner surfaces of the guiding recesses 17 and a distance between the left and right vertical sections 39 of the resilient locking piece 33 exceeds the width of the locking protrusions 15 (see FIG. 6). Thus, the cover 30 is displaceable transversely direction with respect to the fitting 11 due to these dimensional differences.

The wedge base bulb 50 to be mounted into the bulb socket 10 includes the base 51 and a light emitter 52. The base 51 is made e.g. of glass and is a substantially rectangular plate. The light emitter 52 is made e.g. made of glass and is continuous with the upper end edge of the base 51. Two pairs of terminals 53 extend from a filament (not shown) in the light emitter 52 down towards the base 51 and are drawn out from the base 51 through the bottom end of the base 51. The terminals 53 are folded up to extend along the front and rear outer surfaces of the base 51. One pair of terminals 53 is at the front side and the other pair is at the rear side. The retaining projections 54 are formed respectively on the opposite front and rear surfaces of the base 51 and have a substantially rectangular triangular or pointed cross section. The base 51 is inserted into the fitting 11 from above and along the mounting direction MD. In this state, the resilient contact pieces 22 electrically contact the respective terminals 53 and the folded portions of the resilient holding pieces 23 engage the retaining projections 54 to prevent detachment of the base 51 from the fitting 11.

A chuck (not shown) of an automatic apparatus holds the light emitter 52 to insert the base 51 from above and along the mounting direction MD through the through hole 32 of the cover 30 and into the fitting 11. The base 51 might be displaced in a direction intersecting the mounting direction MD (e.g. forward or backward). In this situation, the bottom end edge of the base 51 contacts the front and/or rear guiding slants 35. Thus, the cover 30 is inclined forward or backward and the position of the through hole 32 is displaced forward or backward to follow the base 51 as the cover 30 is inclined. In this way, the base 51 can enter the through hole 32 and, consequently, can be inserted into the fitting 11.

The resilient locking piece 33 that is displaced up when the cover 30 is inclined forward or backward is inclined to approach the front or rear wall 13F or 13R. The resilient locking piece 33 at the opposite side is inclined away from the rear or front wall 13R or 13F without hardly moving vertically (see FIG. 4).

The rib-shaped projection 34 contacts the restricting wall 14 when the cover 30 inclines forward or backward to prevent excessive inclination and to prevent the resilient locking pieces 33 from deforming beyond their resiliency limits.

The substantially frame-shaped cover 30 is mounted at the opening edge of the fitting portion 11 for covering at least parts of the resilient holding pieces 23 and permitting insertion of the base 51. Clearances Cb are formed adjacent to or between the outer surfaces of the parallel front and rear walls 13F, 13R of the fitting 11 and the facing surfaces 42 of the cover 30 that face the walls 13F, 13R. The clearances permit the cover 30 to be displaced in forward and/or backward directions intersecting the mounting direction MD of the base 51 into the fitting 11. Thus, even if the base 51 is displaced forward or backward with respect to the fitting 11, the position of the base 51 can be displaced forward or backward so that the base 51 can be mounted reliably into the fitting 11.

The projections 16 are formed on the outer surfaces of the front and rear walls 13F, 13R and the cover 30 can be brought into line contact with the projections 16 so that the cover 30 is displaced and inclined. Thus, even if the base 51 is displaced with respect to the fitting 11, the cover 30 can be inclined in conformity with the position of the base 51, and the base 51 can be mounted reliably into the fitting portion 11.

The guiding slants 35 are formed at the opening edge of the through hole 32 of the cover 30 to guide the base 51 reliably into the through hole 32.

The invention is not limited to the above described and illustrated embodiment. For example, the following embodiments are also embraced by the technical scope of the present invention as defined by the claims.

Although the guiding slants are formed at the opening edge of the through hole in the foregoing embodiment, they may not be formed or formed in a different number according to the invention.

Although the cover is displaced to be inclined with respect to the fitting in the foregoing embodiment, it may be moved parallel with respect to the fitting according to the invention.

A wedge base bulb of the double bulb type in which two terminal portions are arranged on each of the front and rear surfaces of the base portion is described in the foregoing embodiment. However, the invention also is applicable to wedge base bulbs of the single bulb type in which one terminal is arranged on each of the front and rear surfaces of the base.

Although the projections formed on the front and rear walls are brought into line contact with the cover in the foregoing embodiment, they may be brought into point contact according to the invention.

What is claimed is:

1. A bulb socket, comprising:

a substantially tubular fitting having at least one wall with an opening edge portion and an inner peripheral surface for receiving a base of a wedge base bulb, the wall further including an outer surface formed with at least one projection;

at least one terminal fitting accommodated in the fitting, the terminal fitting being formed with at least one resilient holding piece engageable with the base inserted into the fitting to prevent detachment of the base from the fitting;

a cover mounted to the fitting for covering the resilient holding piece and permitting insertion of the base; and the cover and the fitting being formed to define at least one clearance substantially adjacent at least one outer surface of at least one wall of the fitting for permitting displacement of the cover in at least one direction intersecting a mounting direction of the base into the fitting, the clearance substantially facing at least one surface of the cover that faces the surface of the respective wall, wherein the cover is displaceable to incline with respect to the fitting by coming into line or point contact with the projection of the fitting.

2. The bulb socket of claim 1, wherein the resilient holding piece is arranged to extend along an inner peripheral surface of the fitting.

3. The bulb socket of claim 1, wherein the cover is substantially frame-shaped and is mounted to an opening edge portion of the fitting.

4. The bulb socket of claim 1, wherein at least one guiding slant is formed at an opening edge of a through hole of the cover for guiding insertion of the base.

5. The bulb socket of claim 1, wherein the cover has resilient locking pieces for locking the cover to the fitting, the resilient locking pieces extending substantially along an arrangement direction of the cover to the fitting to interact with locking protrusions of the fitting.

6. The bulb socket of claim 5, wherein the resilient locking piece has a pair of lateral sections and a locking section connecting the lateral sections to define a substantially U-shape, the resilient locking piece being resiliently deformable in a direction intersecting the arranging direction with parts connected with a main portion of the cover substantially as supports.

7. A bulb socket, comprising:

a substantially rectangular tubular fitting for receiving a base of a wedge base bulb, the fitting having opposite front and rear walls, at least one projection being formed on an outer surface of the wall;

at least one terminal fitting accommodated in the fitting, the terminal fitting being formed with at least one resilient holding piece engageable with the base inserted into the fitting to prevent detachment of the base from the fitting; and a frame-shaped cover mounted to the fitting for covering the resilient holding piece, the cover including an opening for permitting insertion of the base, and the cover further being formed to define at least one clearance between the cover and an outer surface of at least one of the front and rear walls of the fitting for permitting displacement of the cover in at least one direction intersecting a mounting direction of the base into the fitting, wherein the cover is displaceable to incline with respect to the fitting by coming into line or point contact with the projection of the fitting.

8. The bulb socket of claim 7, wherein the resilient holding piece is arranged to extend along an inner peripheral surface of the fitting.

9. The bulb socket of claim 7, wherein the cover is mounted to an opening edge portion of the fitting.

10. The bulb socket of claim 7, wherein the outer surfaces of the front and rear walls of the fitting have locking protrusions and the cover has resilient locking pieces for engaging the locking protrusions for locking the cover to the fitting, the resilient locking pieces extending substantially along the mounting direction.

11. A bulb socket comprising:

a substantially rectangular tubular fitting for receiving a base of a wedge base bulb, the fitting having opposite front and rear walls, outer surfaces of the front and rear walls of the fitting having locking protrusions;

at least one terminal fitting accommodated in the fitting, the terminal fitting being formed with at least one resilient holding piece engageable with the base inserted into the fitting to prevent detachment of the base from the fitting; and a frame-shaped cover mounted to the fitting for covering the resilient holding piece, the cover including an opening for permitting insertion of the base, and the cover further being formed to define at least one clearance between the cover and an outer surface of at least one of the front and rear walls of the fitting for permitting displacement of the cover in at least one direction intersecting a mounting direction of the base into the fitting, the cover having resilient locking pieces for engaging the locking protrusions for locking the cover to the fitting, the resilient locking pieces extending substantially along the mounting direction, wherein each of the resilient locking pieces has a pair of lateral sections and a locking section connecting the lateral sections to define a substantially U-shape, the resilient locking pieces being resiliently deformable in directions intersecting the mounting direction.

* * * * *